US009150398B2

(12) United States Patent
Hartel et al.

(10) Patent No.: US 9,150,398 B2
(45) Date of Patent: Oct. 6, 2015

(54) METHOD AND FILLING SYSTEM FOR FILLING CONTAINERS IN A VOLUME AND/OR QUANTITY CONTROLLED MANNER

(75) Inventors: Manfred Hartel, Bretzenheim (DE); Jonathan Lorenz, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 302 days.

(21) Appl. No.: 13/876,614

(22) PCT Filed: Sep. 23, 2011

(86) PCT No.: PCT/EP2011/004759

§ 371 (c)(1), (2), (4) Date: Mar. 28, 2013

(87) PCT Pub. No.: WO2012/048791

PCT Pub. Date: Apr. 19, 2012

(65) Prior Publication Data

US 2013/0220481 A1 Aug. 29, 2013

(30) Foreign Application Priority Data

Oct. 11, 2010 (DE) ..... 10 2010 047 883

(51) Int. Cl.

| | |
|---|---|
| ***B65B 3/30*** | (2006.01) |
| ***B67C 3/20*** | (2006.01) |
| ***B65B 3/32*** | (2006.01) |
| ***B67C 3/04*** | (2006.01) |

(52) U.S. Cl.

CPC . *B67C 3/20* (2013.01); *B65B 3/326* (2013.01); *B67C 3/045* (2013.01); *B67C 3/208* (2013.01)

(58) Field of Classification Search

CPC ..... B65B 3/26; B65B 3/30; B65B 3/326
USPC ..... 141/1, 94, 105–107, 153, 9
See application file for complete search history.

(56) References Cited

U.S. PATENT DOCUMENTS

| | | | | |
|---|---|---|---|---|
| 5,398,734 | A * | 3/1995 | Hartel | 141/82 |
| 6,213,169 | B1 * | 4/2001 | Clusserath | 141/49 |
| 6,474,368 | B2 * | 11/2002 | Clusserath et al. | 141/6 |
| 7,299,607 | B2 * | 11/2007 | Clusserath et al. | 53/503 |
| 7,353,848 | B2 * | 4/2008 | Krulitsch | 141/56 |
| 7,469,726 | B2 * | 12/2008 | Clusserath et al. | 141/57 |
| 7,650,916 | B2 * | 1/2010 | Clusserath | 141/95 |
| 7,866,123 | B2 * | 1/2011 | Clusserath | 53/202 |
| 8,256,474 | B2 * | 9/2012 | Stienen | 141/144 |
| 8,505,594 | B2 * | 8/2013 | Krulitsch | 141/104 |
| 8,517,065 | B2 * | 8/2013 | Conforti | 141/146 |
| 8,590,581 | B2 * | 11/2013 | Clusserath | 141/9 |
| 8,701,719 | B2 * | 4/2014 | Clusserath | 141/9 |
| 8,726,946 | B2 * | 5/2014 | Clusserath et al. | 141/6 |

(Continued)

FOREIGN PATENT DOCUMENTS

DE 102009049583 5/2011

*Primary Examiner* — Nicolas A Arnett
(74) *Attorney, Agent, or Firm* — Occhiuti & Rohlicek LLP

(57) ABSTRACT

A filling element includes a channel that forms a delivery opening for delivering filling into a container, a valve arranged in the channel for opening and closing the filling element, the valve being connected by a control valve device to sources for a main and additional component of the filling, and a filling-material section common to the components and forming a space. The element also includes flow meters for measuring volumetric flow of the filling and generating corresponding electrical measurement signals.

21 Claims, 2 Drawing Sheets

(56) References Cited

U.S. PATENT DOCUMENTS

| | | | | |
|---|---|---|---|---|
| 8,763,654 | B2 * | 7/2014 | Gras et al. | 141/104 |
| 2001/0045242 | A1 * | 11/2001 | Clusserath et al. | 141/144 |
| 2005/0241726 | A1 * | 11/2005 | Clusserath et al. | 141/144 |
| 2005/0262804 | A1 * | 12/2005 | Clusserath et al. | 53/281 |
| 2009/0236007 | A1 * | 9/2009 | Clusserath et al. | 141/9 |
| 2009/0293985 | A1 * | 12/2009 | Till et al. | 141/1 |
| 2010/0000182 | A1 * | 1/2010 | Clusserath | 53/284.5 |
| 2010/0108180 | A1 * | 5/2010 | Clusserath | 141/1 |
| 2011/0039044 | A1 * | 2/2011 | Clusserath | 428/34.1 |
| 2011/0303325 | A1 * | 12/2011 | Gras et al. | 141/105 |
| 2012/0186695 | A1 * | 7/2012 | Clusserath | 141/115 |
| 2013/0180619 | A1 * | 7/2013 | Clusserath et al. | 141/6 |
| 2013/0220481 | A1 * | 8/2013 | Hartel et al. | 141/9 |
| 2014/0345745 | A1 * | 11/2014 | Fahldieck et al. | 141/9 |

* cited by examiner

METHOD AND FILLING SYSTEM FOR FILLING CONTAINERS IN A VOLUME AND/OR QUANTITY CONTROLLED MANNER

CROSS REFERENCE TO RELATED APPLICATION

This application is the national phase application under 35 USC 371 of international application no. PCT/EP2011/004759, filed Sep. 23, 2011, which claims the benefit of the priority date of German application no. 10 2010 047 883.0, filed Oct. 11, 2010. The contents of the aforementioned applications are incorporated herein in their entirety.

FIELD OF DISCLOSURE

The invention relates to quantity-controlled filling of a container with a filling material having a main component and an additional component.

BACKGROUND

It is known to determine the liquid volume of products that are filled in containers by measuring volumetric flow rate using flow meters. These known flow meters include magnetically inductive flow meters (MID's) that have no moving functional elements. Such measurements are known for their accuracy and robustness.

In the case of products containing solids or solid constituents however, measurements of the liquid volume or volumetric flow rate of filling material that is being delivered to the container are apt to be incorrect. These measurement errors can occur because, during the measurement, solids settle on the inner surfaces of the magnetically-inductive flow meters that are often used for this purpose. As a result of these solids, the product flowing through these flow meters will appear to have a highly variable conductivity. This contributes to incorrect measurements.

These inaccuracies occur even when products containing such solids or solid constituents are delivered to the container that is to be filled as separate first and second components, one of which is substantially solid-free and the other of which is a proportionally metered additional component that contains the solids or solid constituents in greater concentration, but not so great a concentration as to render it incapable of flowing.

SUMMARY

An object of the invention is that of promoting promotes accurate volume-controlled and/or quantity-controlled filling of containers with products containing solids or solid constituents.

In the case of the invention, the filling of the containers with the product or filling material containing the solids or solid constituents is effected by introducing this filling material into the respective container in the form of at least one solid-free or substantially solid-free main component and separately therefrom with an additional component, which contains the solids or solid constituents but not at a concentration sufficient to suppress its flowability.

In the inventive method, the metering or proportioning, i.e. the determination of the fill volume of the additional component, is carried out indirectly by measuring the volume of main component that is displaced by the volume of the additional component introduced into either a storage space or a proportioning space. This measurement is carried out with a flow meter through which only the solid-free, or substantially solid-free, main component flows. This method avoids impairments or incorrect measurements due to solids or solid constituents when determining the volume of this additional component.

In a preferred embodiment, the flow meters are magnetically inductive flow meters. Such flow meters are particularly inexpensive, robust and universally or almost universally usable for measuring the volumetric flow rate of a liquid product with sufficient electrical conductivity. Such flow meters can also measure accumulated volume by integrating flow rate over time.

In one aspect, the invention a method for quantity-controlled filling of a container with a filling material having a main component and an additional component. Such a method includes, during a filling process, controlling introduction of the main component and the additional component into the container as it passes through a common filling-material section in a filling element by using a flow-metering device associated with the filling element so as to end the filling process when the main component and the additional component have been introduced according to a required fill volume. Controlling introduction of the main component and the additional component comprises providing at least two magnetically inductive flow meters for use as a flow-metering device. The magnetically inductive flow meters are spaced apart from one another relative to a direction of flow of the filling material. The method further includes, at the beginning of a filling process, filling the filling-material section and a liquid space of the filling element with only the main component, the liquid space of the filling element being permanently connected to the filling-material section. The method further includes, during the filling process, in at least one preceding process section, introducing the additional component into a space formed by the filling-material section. The space is either a storage space or a proportioning space. The method continues with using a flow meter through which only the main component flows to indirectly determine a volume of the additional component flowing into the space by measuring a volume of the main component displaced by the additional component from either the filling-material section or the space. The method continues with the step of ending introduction of the additional component into the space when a volume of first component displaced by the second component from one of the filling-material section and the space, as measured with at least one flow meter, has reached a particular value, in a subsequent process step. The method further includes introducing the main component into the filling-material section, through the filling element, and into the container, while concurrently entraining the additional component from the space, and measuring a volume of the main component flowing to the container using a flow meter through which only the main component flows.

Some practices include, in the preceding process section, measuring a volume of the main component using one of the downstream flow meters. In this context, and throughout this specification, downstream and upstream are determined based on the filling material's flow direction.

Other practices include measuring a volume of the main component using a flow meter upstream of the space.

Yet other practices include those in which a process sequence consisting of a preceding process step and the subsequent process step is carried out at most once during the filling process and those in which it is carried out at least twice during the filling process.

In additional practices, a process sequence consisting of a preceding process step and the subsequent process step is carried out at most twice during the filling process. Among these practices are those that include, during the preceding process step, causing the main component to be displaced from the space by introducing the additional component into the container to be filled, and those that include, during the preceding process step, detecting that the filling element is closed, and causing the main component to be displaced from the space into an additional channel from which the main component is returned to a tank for the main component.

Additional practices also include feeding the main component into the filling-material section by controlled opening and closing of a first control valve, and feeding the additional component into the filling-material section by controlled opening and closing of a second control valve, and using a flow meter through which the main component flows downstream of the first control valve, measuring a volume of the main component in the subsequent process step.

Additional practices include feeding the main component into the filling-material section by controlled opening and closing of a first control valve, feeding the additional component into the filling-material section by controlled opening and closing of a second control valve, and using a flow meter through which the main component flows upstream of the first control valve, measuring a volume of the main component in the subsequent process step.

Yet other practices include, in a preceding process step, measuring a volume of the main component displaced from the filling-material section using a flow meter provided in the filling-material section downstream of the space in a direction of flow of the filling material.

Also among the practices of the invention are those that further include, in a preceding process step, measuring a volume of the main component displaced from the filling-material section using a flow meter provided in a liquid connection connecting a liquid channel of the filling element to the additional channel.

Additional practices include those that have a further step of closing the liquid connection during the subsequent process step.

Yet other practices include selecting the additional component to comprise a flowable base of solid constituents, and selecting the main component to be a liquid free of solid constituents.

In another aspect, the invention features an apparatus for filling containers. Such an apparatus includes a filling system for quantity-controlled filling of containers with a filling material that is made of a main component and an additional component. The filling system has a filling element that includes a liquid channel that forms a delivery opening for delivering the filling material into a container arranged at the filling element. A liquid valve arranged in the liquid channel enables controlled opening and closing of the filling element. The liquid valve is connected by a control valve device, which comprises at least two control valves, to a source for the main component and to a source for the additional component. A filling-material section common to the main component and to the additional component forms a space that is either a storage space or a proportioning space for proportioning of the additional component. A first flow meter measures volumetric flow of the filling material and generates a corresponding electrical measurement signal. The first flow meter is arranged in either the filling-material section downstream of the space in a direction of flow of the filling material or in a controlled connection connecting the liquid channel of the filling element to either an auxiliary channel or an additional channel. The controlled connection has a further control valve. The apparatus further includes a second flow meter configured for measuring volumetric flow of the filling material and generating a corresponding electrical measurement signal. The second flow meter is arranged in either a filling-material section downstream of the control valve device in the direction of flow of the filling material or in a connection that carries only the main component, and upstream of the control valve array in a direction of flow of the main component.

Embodiments include those in which the first and second flow meters comprise magnetically inductive flow meters.

In other embodiments, the controlled connection extends between the liquid channel and an auxiliary channel when the first flow meter is arranged in the filling-material section. Among these embodiments are those in which the controlled connection between the liquid channel and the auxiliary channel comprises a part of a hot circulation system for the main component, and those in which it does not.

In some embodiments, a line forms the filling-material section. The line is either a product line or a pipeline between the control valve device and either the filling element or a filling material connector of the filling element. Among these are embodiments in which the line comprises a product line having at least one region in which the product line extends vertically and those in which the line is a coil-shaped product line that forms the space.

Embodiments also include those that further comprise a rotary filling machine that has a rotor that rotates around the machine axis, and plural filling elements or at least one filling element. In these embodiments, the filling system is part of the rotary filling machine. The filling-material section, the control valve arrangement connecting the filling-material section in a controlled manner to the source of the main component and to the source of the additional component, the first and second flow meter, and the additional, controllable connection are all provided discretely for each filling element.

As used herein, the term "container" includes cans, bottles, tubes, pouches made of metal, glass and/or plastic, as well as other packaging containers suitable for filling liquid or viscous products for a pressurized filling or for unpressurized filling.

As used herein, the term "open-jet filling" refers to a method in which the filling material flows to the container to be filled in an open filling jet, with the container not lying with its container mouth or container opening directly against the filling element but being spaced apart from the filling element or from the latter's filling material outlet, or delivery opening.

As used herein, the term "filling material" includes liquid or flowable products that contain solids or solid constituents, e.g. particles and/or fibers, in a liquid or flowable base or matrix, for example fruit or vegetable juices having fruit or vegetable pieces/fibers.

As used herein, "only the main component" is intended to include a mixture of the main component and an insignificant amount of any other component.

As used herein, "substantially" means variations from an exact value by ±10%, preferably by ±5%, and/or variations in form of changes insignificant for the function.

Further embodiments, advantages and possible applications of the invention arise out of the following description of embodiments and out of the figures. All of the described and/or pictorially represented attributes whether alone or in any desired combination are fundamentally the subject matter of the invention independently of their synopsis in the claims or a retroactive application thereof. The content of the claims is also made an integral part of the description.

BRIEF DESCRIPTION OF THE DRAWINGS

The invention is explained in detail below through the use of representative embodiments, and accompanying figures, in which.

DETAILED DESCRIPTION

Figure 1:
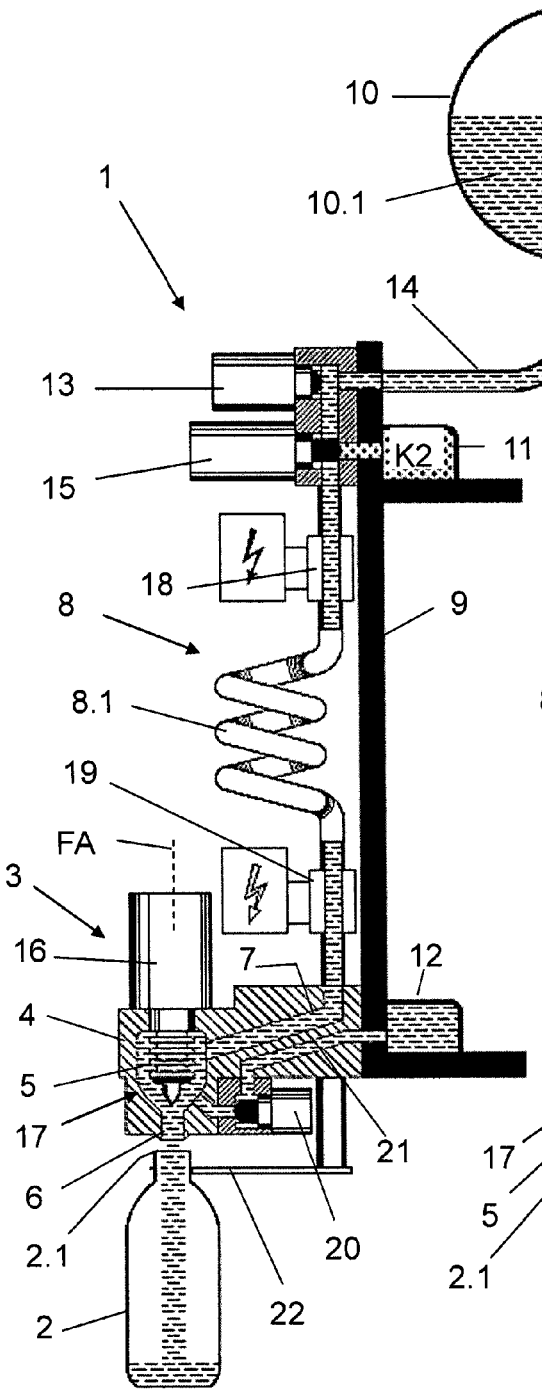
FIGS. 1 and 2 show a simplified schematic diagram of a filling system for filling containers with a two-component liquid filling material in different phases or process steps of a filling process.
Figure 2:
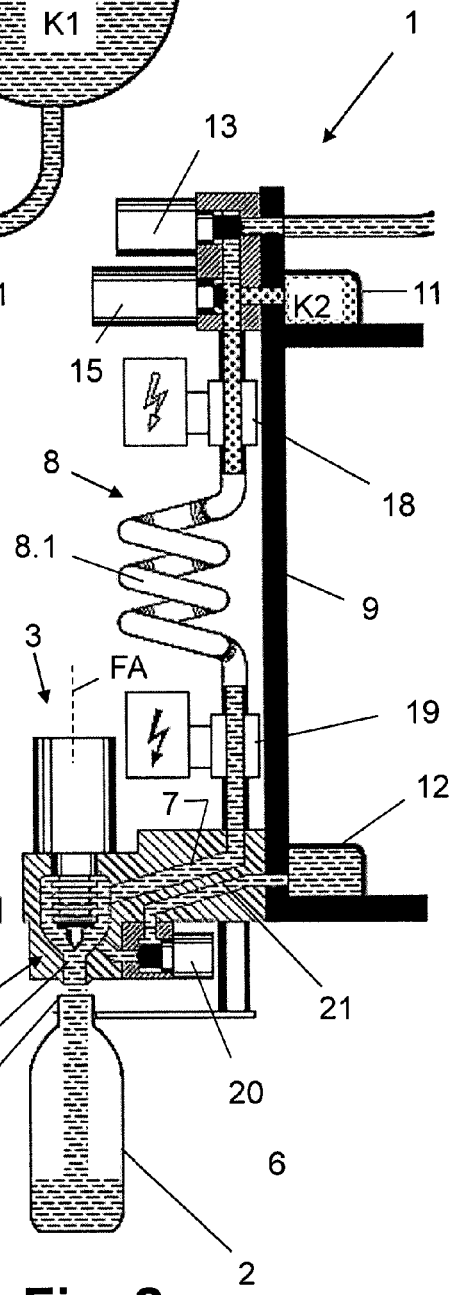

A first filling system 1, which is shown in FIGS. 1 and 2, is used for filling containers, which are depicted, by way of example as, bottles 2, with a liquid filling material that comprises a main component K1 and an additional component K2. The main component K1 is liquid, i.e. it contains no or substantially no solids or solid constituents. Examples of a main component K1 include fruit juice and vegetable juice. The additional component K2, while still liquid or flowable, contains a high concentration of solids or solid constituents. Examples of solid constituents include fruit or vegetable fibers, or fruit or vegetable constituents, including pulp.

The main component K1 and the additional component K2 are introduced one after the other into a bottle in a filling process in the manner described below in more detail. The mixing of these components takes place substantially only when they are in respective bottle 2.

The main component K1 and the additional component K2 are introduced into a bottle 2 such that, in at least one filling phase of the filling process, the required fill volume of the main component K1 and the required fill volume of the additional component K2 are introduced into the bottle 2 that is to be filled.

The first filling system 1 comprises a filling element 3 in whose housing 4 there is provided a liquid channel 5 that forms a delivery opening 6 on the underside of the housing 4 and that, at its upper region, facing away from this delivery opening 6, is connected by a connector 7 to a lower end of a metering or product line 8. The filling element 3 is part of a rotary filling machine. It is provided for this purpose, together with a plurality of similar filling elements 3, on a periphery of a rotor 9 that is rotationally driven about a vertical machine axis and on which there is provided, among other things, a tank 10 for the main component K1, a ring channel 11 for the additional component K2 and a ring channel 12. Each of these is common to all filling elements 3 of the filling machine.

The ring channel 12 forms part of a hot circulation for the main component K1 by which not only the main component K1 but also all of the functional elements of the first filling system 1 that carry that component are held at a high temperature necessary for hot sterile filling.

During filling operations, the tank 10 is partially filled in a level-controlled manner with the main component K1, thereby forming a liquid space 10.1, which is occupied by the main component K1. Above the liquid surface of the main component K1 is a gas space 10.2, which is filled, for example, with an inert gas.

The upper end of the product line 8 can be connected in a controlled manner by a control valve device or a first control valve 13 of that device to the liquid space 10.1 of the tank 10 via a feeder line 14. The upper end of the product line 8 can be connected in a controlled manner by a second control valve 15 of the control valve device to a ring channel 11 that carries the additional component K2. The product line 8 and the first and second control valves 13, 15 are provided independently for each filling element 3 of the filling machine.

Inside the liquid channel 5, between the connector 7 and the delivery opening 6, is a liquid valve 17. An operating device 16 operates the liquid valve 17. In so doing, the operating device 16 controls the volume and/or quantity-controlled delivery of the filling material into a bottle 2, and the connection between the connector 7 and the delivery opening 6. In particular, the operating device 16 opens the liquid valve 17 at the beginning of a filling process and closes it at the end of the filling process in a controlled manner and as a function of electrical measurement signals of a first flow meter 18 and a second flow meter 19.

The first and second flow meters 18, 19, which can be magnetically inductive flow meters (MID's), each measure and/or capture the volumetric flow rate of the first component K1 through the product line 8. The first and second flow meters 18, 19 are disposed in the product line 8 spatially apart from each other such that the first flow meter 18 is located in an upper region of the product line 8, downstream of the first and second control valves 13, 15, and the second flow meter 19 is located in a lower region of the product line 8, upstream of the connector 7.

Between the first and second flow meters 18, 19, the product line 8 forms a product-line section 8.1, which is depicted as a coil in FIGS. 1 and 2. The product-line section 8.1 serves as a storage or proportioning space having a volume that is at least equal to the greatest fill volume of the additional component K2 that is to be introduced into a bottle 2 in one process step of the filling process but less than the fill volume of the main component K1 that is to be introduced into a bottle 2 during the filling process.

If the filling element 3 is provided for a hot filling, then a liquid connection 21 having a third control valve 20 is further provided in the filling element 3 or in the housing 4 for connecting the liquid channel 5 to the ring channel 12 in a controlled manner and in such a way that even when the liquid valve 17 is closed, i.e. before starting and/or after finishing the filling process, and with the first and third control valves 13, 20 open, a flow connection exists from the liquid space 10.1, through the product line 8, through the liquid channel 5, through the open liquid connection 21, into the ring channel 12, and, from there, via a connection having a heating device, back to the tank 10 for hot circulation of the main component K1.

For open-jet filling, the bottle 2 is arranged with its bottle opening 2.1 below and at a distance away from the delivery opening 6, with its bottle axis lying on the same axis as the a vertical filling element axis FA. In the depicted embodiment, a container carrier 22 associated with each filling element 3 and provided on the rotor 9 suspends the bottle 2 by its mouth flange.

The operation of the first filling system 1 can be described as follows:

During a filling operation, before the start of the filling process, the liquid channel 5, at least upstream of the liquid valve 17, the connector 7, and the product line 8 are completely filled with the filling material, and preferably only with the main component K1. During the filling process, the third control valve 20 is also in closed and remains closed for the hot circulation until the end of the filling process.

At the beginning of each filling process, with the first and third control valves 13, 20 closed, the liquid valve 17 and the second control valve 15 open in a first or preceding process step to allow additional component K2 to pass from the ring channel 11 into the product line 8 or the product-line section 8.1. This displaces part of the main component K1 already present in the product line 8 through the opened liquid valve 17 and into the bottle 2. The volume of the main component K1 that is displaced by the additional component K2 from the product line 8 equals the volume of the additional component K2 introduced into the product line 8. This volume is measured by the second flow meter 19, through which only the main component K1 flows in this process step.

When the volume measured by the second flow meter 19 equals the required fill volume of the additional component K2 to be introduced into the bottle 2, the second control valve 15 is closed. The second flow meter 19 therefore measures the partial volume of main component K1 introduced into the bottle 2 in the preceding process step and, at the same time, the volume of the additional component K2 that is introduced, i.e. proportioned, into the product line 8 or into the product-line section 8.1.

In a second or subsequent process step, with the liquid valve 17 still open and the second and third control valves 15, 20 still closed, the first control valve 13 opens so that then when the product line 8, the product-line section 8.1, the connector 7 and the liquid channel 5 are purged with the main component K1, the entire volume of the additional component K2 initially present, i.e. proportioned, in the product line 8, is introduced into the bottle 2. Following this, the product line 8, the product-line section 8.1, the connector 7, and the liquid channel 5 are once again filled solely and completely with the main component K1. The volume of the main component K1 flowing into the bottle 2 is initially measured with the second flow meter 19 and then later with the first flow meter 18. However, only the measurement signal from the particular flow meter 18, 19 through which no additional component K2 is currently flowing will actually be used for the quantity-based and/or volume-based control of the filling process.

Taking into account the volumes of product line 8, the connector 7, and the liquid channel 5, which are all determined by design and hence known, and taking into account the volume of the main component K1, which was already introduced into the bottle 2 in the first process step, and possibly also taking into account further filling parameters, such as the temperature of the main component K1 and the additional component K2, the liquid valve 17 and the first control valve 13 are closed to end the filling process when the main component K1 is also introduced into the bottle 2 with the required fill volume. At the end of every filling process, the third control valve 20 opens again for the next hot circulation while the liquid valve 17 closes.

The fact that, in the first filling system 1, the third control valve 20 closes throughout the entire filling process effectively prevents the additional component K2 or its constituents from entering the ring channel 12 and hence the hot circulation.

Figures 3, 4:
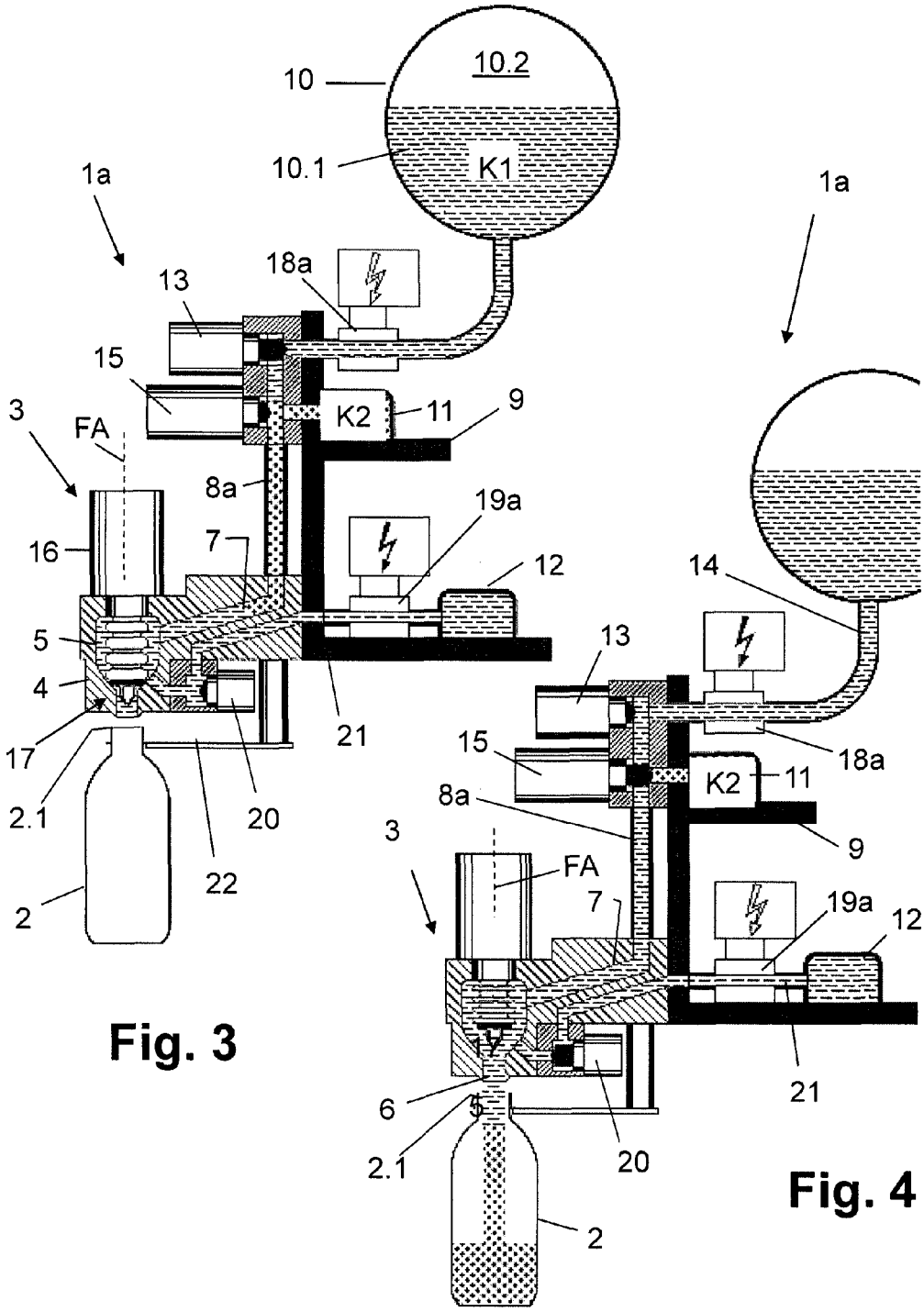
FIGS. 3 and 4 show similar depictions to FIGS. 1 and 2 with an extended embodiment of the inventive filling system.

FIGS. 3 and 4 show a second filling system 1*a* that is similar to that shown in FIGS. 1 and 2. The only essential difference between the two filling systems is that, in the filling system shown in FIGS. 3 and 4, there are no flow meters provided in the product line indicated 8*a*. Instead, for each filling element 3 of the second filling system 1*a*, a first flow meter 18*a* and a second flow meter 19*a* are discretely arranged in the connecting line 14 and in the liquid connection 21 respectively. Otherwise, the second filling system 1*a* in FIGS. 3 and 4 is the same as the first filling system 1 shown in FIGS. 1 and 2. Hence, those parts and/or components that are the same as corresponding parts in FIGS. 1 and 2 are marked with the same reference numbers.

The volume of the product line 8*a* and of the connector 7 is greater than the volume of the additional component K2 that is introduced into the bottle 2 in a process step, but less than the volume of the main component K1 to be introduced into the bottle 2.

The following filling method is possible with the second filling system 1*a*, with the product line 8*a*, with the connector 7, and with the liquid channel 5 upstream of the liquid valve 17 being completely filled with the main component K1 at the beginning of each filling process:

At the beginning of the filling process, in a first or preceding process step, with the liquid valve 17 and the first control valve 13 closed and the third control valve 20 opened, the second control valve 15 opens so that the additional component K2 passes from the ring channel 11, through the second control valve 15, and into the product line 8. This at least partially displaces the main component K1, hitherto present in the product line 8*a*, through the connector 7, the liquid channel 11, and the liquid connection 21 into the ring channel 12. The volume of displaced main component K1 flowing through the liquid connection 21 equals the volume of the additional component K2 flowing into the product line 8*a* and is measured by a first flow meter 19*a*. As soon as the volume measured by first flow meter 19*a* equals the fill volume of the additional component K2 that is to be introduced into bottle 2, the second control valve 15 and the third control valve 20 are closed. The required fill volume of the additional component K2 is now in product line 8*a* and possibly also partially in the connector 7.

In a second or subsequent process step, after the third control valve 20 has been closed, the main component K1 is introduced from the tank 10 and into the product line 8*a* by opening the liquid valve 17 and the first control valve 13. As a result, the volume of the additional component K2 therein present is initially introduced into the bottle 2 via the liquid connection comprising the product line 8*a*, the connector 7, and the liquid channel 5. The liquid connection is completely purged with the main component K1 so that it is in turn filled solely with the main component K1. The volume of the main component K1 flowing to the product line 8*a* from the tank 10 is measured by the first flow meter 18*a*. Taking into account the volume of the liquid connection between the first control valve 13 and the delivery opening 6, which is determined by the design and hence known, i.e. taking into account the known volumes of the product line 8*a*, the connector 7, and the liquid channel 5 and possibly also taking into account further filling parameters, such as the temperature of the main component K1, the additional component K2, the closing of the liquid valve 17 by the operating device 16, and hence the ending of the filling process, takes place when the main component K1 is also introduced into the bottle 2 with the required fill volume. At the end of each filling process, the third control valve 20 opens again for the hot circulation of the main component K1 while the first control valve 13 remains open.

In the second filling system 1*a*, the fill volume of the additional component K2 that is to be introduced into the bottle 2 is also determined indirectly based on a measurement of volume of the main component K1 that is displaced by the additional component K2 and measured with the first and second flow meters 18*a*, 19*a*.

With the second filling system 1*a*, the liquid valve 17 is closed during the proportioning of the additional component K2, i.e. during the introduction of the additional component K2 into the product channel 8*a*. With a rotary filling machine that uses the second filling system 1*a*, the proportioning of the additional component K2 can therefore already take place in the angular range of the rotary motion of rotor 9 between a container outlet and a container inlet of the filling machine.

This angular region is often called "the lost angle" of the rotary motion of rotor 9 because it cannot be used to carry a bottle 2. This significantly increases the angular range of the rotary motion of rotor 9 that can be used for the entire filling process and also gains a considerable amount of process time for the filling process. The result is a significant increase in the number of bottles 2 filled per unit of time for a given rotor diameter.

The apparatus described herein also avoids incorrect measurements by flow meters caused by solid constituents in the filling material. This results in a high proportioning precision for the introduction of the main component K1 and the additional component K2 into bottles 2 and a high precision of the total fill volume introduced into each bottle 2.

The invention has been described above by reference to particular embodiments. It goes without saying that numerous variations as well as modifications are possible without departing from the inventive concept underlying the invention. All references in the description thus far have been to volume or fill volume. These terms are equivalent to "quantity" or "fill quantity."

Thus far, the present invention has been explained mainly by reference to filling elements 3 for hot filling of products. However, the invention can be applied to filling elements that are not used for hot filling of products.

Thus far, it has also been assumed that it is only in one process step of the total filling process that the additional component K2 is introduced into the metering and storage space formed by the product-line section 8.1 or by product line 8*a* and possibly also partially by connector 7, and in a subsequent process step is brought out of the space with the main component K1 into bottle 2. However, it is also possible, in particular with large-volume bottles 2 or other large-volume containers, to carry the aforementioned process steps twice or multiple times repeatedly in the filling process. In each case however the measurement of the fill volume of the additional component K2 is carried out indirectly by measuring the volume of the main component K1 that is displaced by that component, such that the filling process can be controlled base solely on signals from that flow meter through which only the main component flows.

Having described the invention, and a preferred embodiment thereof, what is new, and secured by Letters Patent is:

1. A method for quantity-controlled filling of a container with a filling material having a main component and an additional component, said method comprising during a filling process, controlling introduction of said main component and said additional component into said container through a common filling-material section and a filling element by using a flow-metering device associated with said filling element so as to end said filling process when said main component and said additional component have been introduced according to a required fill volume, wherein controlling introduction of said main component and said additional component comprises providing at least two magnetically inductive flow meters for use as a flow-metering device, said magnetically inductive flow meters being spaced apart from one another relative to a direction of flow of said filling material, at the beginning of a filling process, filling said filling-material section and a liquid space of said filling element with only said main component, said liquid space of said filling element being permanently connected to said filling-material section, during said filling process, in at least one preceding process section, introducing said additional component into a space formed by said filling-material section, said space being selected from the group consisting of a storage space and a proportioning space, using at least one of said flow meters through which only said main component flows, indirectly determining a volume of said additional component flowing into said space by measuring a volume of said main component displaced by said additional component from one of said filling-material section and said space, ending introduction of said additional component into said space when a volume of first component displaced by said second component from one of said filling-material section and said space, as measured with at least one flow meter, has reached a particular value, in a subsequent process step, introducing said main component into said filling-material section, through said filling element, and into said container, while concurrently entraining said additional component from said space, and measuring a volume of said main component flowing to said container using at least one flow meter through which only said main component flows.

2. The method of claim 1, further comprising, in said preceding process section, measuring a volume of said main component using at least one of said flow meters downstream of said space in a direction of flow of said filling material.

3. The method of claim 1, further comprising, in a subsequent process section, measuring a volume of said main component using at least one of said flow meters upstream of said space in a direction of flow of said filling material.

4. The method of claim 1, wherein a process sequence consisting of a preceding process step and said subsequent process step is carried out at most once during said filling process.

5. The method of claim 1, wherein a process sequence consisting of a preceding process step and said subsequent process step is carried out at most twice during said filling process.

6. The method of claim 5, said method further comprising, during said preceding process step, causing said main component to be displaced from said space by introducing said additional component into said container to be filled.

7. The method of claim 5, said method further comprising, during said preceding process step, detecting that said filling element is closed, and causing said main component to be displaced from said space into an additional channel from which said main component is returned to a tank for said main component.

8. The method of claim 1, further comprising feeding said main component into said filling-material section by controlled opening and closing of a first control valve, and feeding said additional component into said filling-material section by controlled opening and closing of a second control valve, and using a flow meter through which said main component flows downstream of said first control valve, measuring a volume of said main component in said subsequent process step.

9. The method of claim 1, further comprising feeding said main component into said filling-material section by controlled opening and closing of a first control valve, and feeding said additional component into said filling-material section by controlled opening and closing of a second control valve, and using a flow meter through which said main component flows upstream of said first control valve, measuring a volume of said main component in said subsequent process step.

10. The method of claim 1, further comprising, in a preceding process step, measuring a volume of said main component displaced from said filling-material section using a flow meter provided in said filling-material section downstream of said space in a direction of flow of said filling material.

11. The method of claim 1, further comprising, in a preceding process step, measuring a volume of said main component displaced from said filling-material section using a flow meter provided in a liquid connection connecting a liquid channel of said filling element to said additional channel.

12. The method of claim 11, further comprising closing said liquid connection during said subsequent process step.

13. The method of claim 1, further comprising selecting said additional component to comprise a flowable base of solid constituents, and selecting said main component to be a liquid free of solid constituents.

14. An apparatus for filling containers, said apparatus comprising a filling system for quantity-controlled filling of containers with a filling material comprising a main component and an additional component, said filling system comprising a filling element comprising a liquid channel that forms a delivery opening for delivering said filling material into a container arranged at said filling element, a liquid valve arranged in said liquid channel for controlled opening and closing of said filling element, said liquid valve being connected by a control valve device, which comprises at least two control valves, to a source for said main component and to a source for said additional component, a filling-material section common to said main component and to said additional component and forming a space, said space being selected from the group consisting of a storage space and a proportioning space for proportioning of said additional component, a first flow meter configured for measuring volumetric flow of said filling material and generating a corresponding electrical measurement signal, said first flow meter being arranged in one of said filling-material section downstream of said space in a direction of flow of said filling material and in a controlled connection connecting said liquid channel of said filling element to a channel selected from the group consisting of an auxiliary channel and an additional channel, said controlled connection comprising a further control valve, and a second flow meter configured for measuring volumetric flow of said filling material and generating a corresponding electrical measurement signal, said second flow meter being arranged in one of said filling-material section downstream of said control valve device in said direction of flow of said filling material, and in a connection carrying only said main component, upstream of said control valve array in a direction of flow of said main component.

15. The apparatus of claim 14, wherein said first and second flow meters comprise magnetically inductive flow meters.

16. The apparatus of claim 14, wherein said controlled connection extends between said liquid channel and an auxiliary channel when said first flow meter is arranged in said filling-material section.

17. The apparatus of claim 16, wherein said controlled connection between said liquid channel and said auxiliary channel comprises a part of a hot circulation system for said main component.

18. The apparatus of claim 14, wherein said filling-material section is formed by a line selected from the group consisting of a product line and a pipeline between said control valve device and a location selected from the group consisting of said the filling element and a filling material connector of said filling element.

19. The apparatus of claim 18, wherein said line comprises a product line having at least one region in which said product line extends vertically.

20. The apparatus of claim 18, wherein said product line is coil-shaped and forms said space.

21. The apparatus of claim 14, further comprising a rotary filling machine, said rotary filling machine comprising a rotor that rotates about a vertical machine axis, and at least one filling element, wherein said filling system is part of said rotary filling machine, wherein said filling-material section, said control valve arrangement connecting said filling-material section in a controlled manner to said source of said main component and to said source of said additional component, said first and second flow meter, and said additional, controllable connection are provided discretely for each filling element.

* * * * *